US007967643B1

(12) United States Patent
D'Addario et al.

(10) Patent No.: US 7,967,643 B1
(45) Date of Patent: Jun. 28, 2011

(54) PHONE PLUG SIGNAL TIP

(75) Inventors: James D'Addario, Old Westbury, NY (US); Robert O. Miller, Deer Park, NY (US)

(73) Assignee: D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 12/804,736

(22) Filed: Jul. 28, 2010

(51) Int. Cl.
*H01R 24/00* (2011.01)

(52) U.S. Cl. ..... 439/669

(58) Field of Classification Search ..... 439/668, 439/669, 675
See application file for complete search history.

(56) References Cited

U.S. PATENT DOCUMENTS 7,614,918 B1 * 11/2009 Wu ..... 439/669
7,618,294 B1 * 11/2009 Lin et al. ..... 439/669
7,699,665 B1 * 4/2010 Yin ..... 439/669
7,727,029 B2 * 6/2010 Bolin et al. ..... 439/669

* cited by examiner

*Primary Examiner* — Khiem Nguyen
(74) *Attorney, Agent, or Firm* — Alix, Yale & Ristas, LLP

(57) ABSTRACT

An electric plug having a central signal shaft terminating in a tip, wherein the tip has a substantially frustoconical nose, a convex annular shoulder centered at an axial distance of less than 0.120 inch from the front end of the tip, (defining a bulbous portion) and a concave waist having a radius of curvature greater than about 0.75 inch, defining the detent adjacent to the bulbous portion.

18 Claims, 4 Drawing Sheets

PHONE PLUG SIGNAL TIP

BACKGROUND

The present invention relates to concentric electrical connectors and, particularly, to the type of connector commonly known as a "phone plug" that is commonly used to connect musical instruments to amplifiers or other such equipment.

The dimensions of such plugs and associated jacks have been set according to JIS (Japan Industry Standard) whereby manufacturers of various components will be sure of interchangeability and connectivity by purchasers of components from various sources. Notwithstanding such standards, the ¼ inch diameter male phone plugs and jacks do not always mate as specified. In particular, whereas most commercially available male plugs conform closely to the standard specification, many female jacks (receptacles) are quite far out of specification. The inside of a jack usually includes some form of spring contact that is designed to contact a detent in the tip of the male plug. When the spring contact is either too short or too long in length, poor electrical contact with the plug tip degrades the musician's performance. This condition can cause the plug to have minimal retention of the plug to the jack, and in some cases the spring contact can actually push the plug out of the jack, causing total loss of electrical connection.

SUMMARY

We have improved the shape of the standard phone plug tip to provide greater accommodation of jack springs that are out of specification.

This has been achieved by moving the convex, bulbous portion of the tip forward, away from the plug body, and increasing the length of the adjacent concave, detent portion. This change significantly increases the retention between the plug and poorly manufactured jacks, while not adversely affecting the plugs used in jacks that are made to specification.

Preferably, the annular shoulder is centered closer to the front end, the waist extends axially a longer distance, and the minimum diameter of the waist is slightly greater, than in the standard tip.

One embodiment is directed to an electric plug having a central signal shaft terminating in a tip, wherein the tip has a substantially frustoconical nose, a convex annular shoulder centered at an axial distance of less than 0.120 inch from the front end of the tip, (defining a bulbous portion) and a concave waist having a radius of curvature greater than about 0.75 inch, defining the detent adjacent to the bulbous portion.

The invention is also directed to the tip itself, which preferably has a standard threaded bore, such that the inventive tip can be substituted for a standard tip and thereby dramatically improve the performance of what was originally a standard plug.

DETAILED DESCRIPTION

Figure 1:
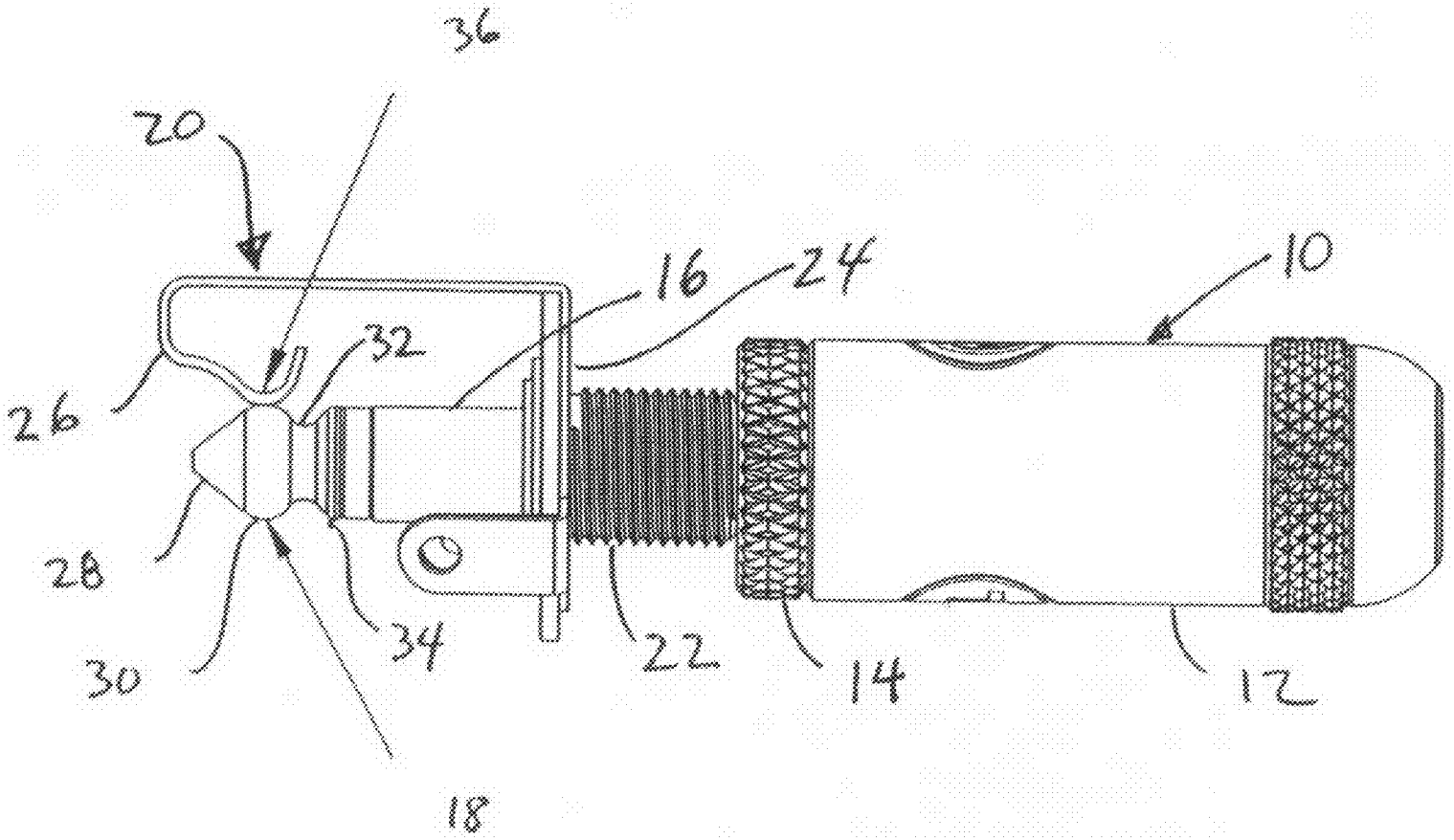
FIG. 1 shows a standard phone plug fully inserted into a standard jack in which the contact point on the jack spring is out of specification because it is too far from the front wall of the jack.
Figure 3:
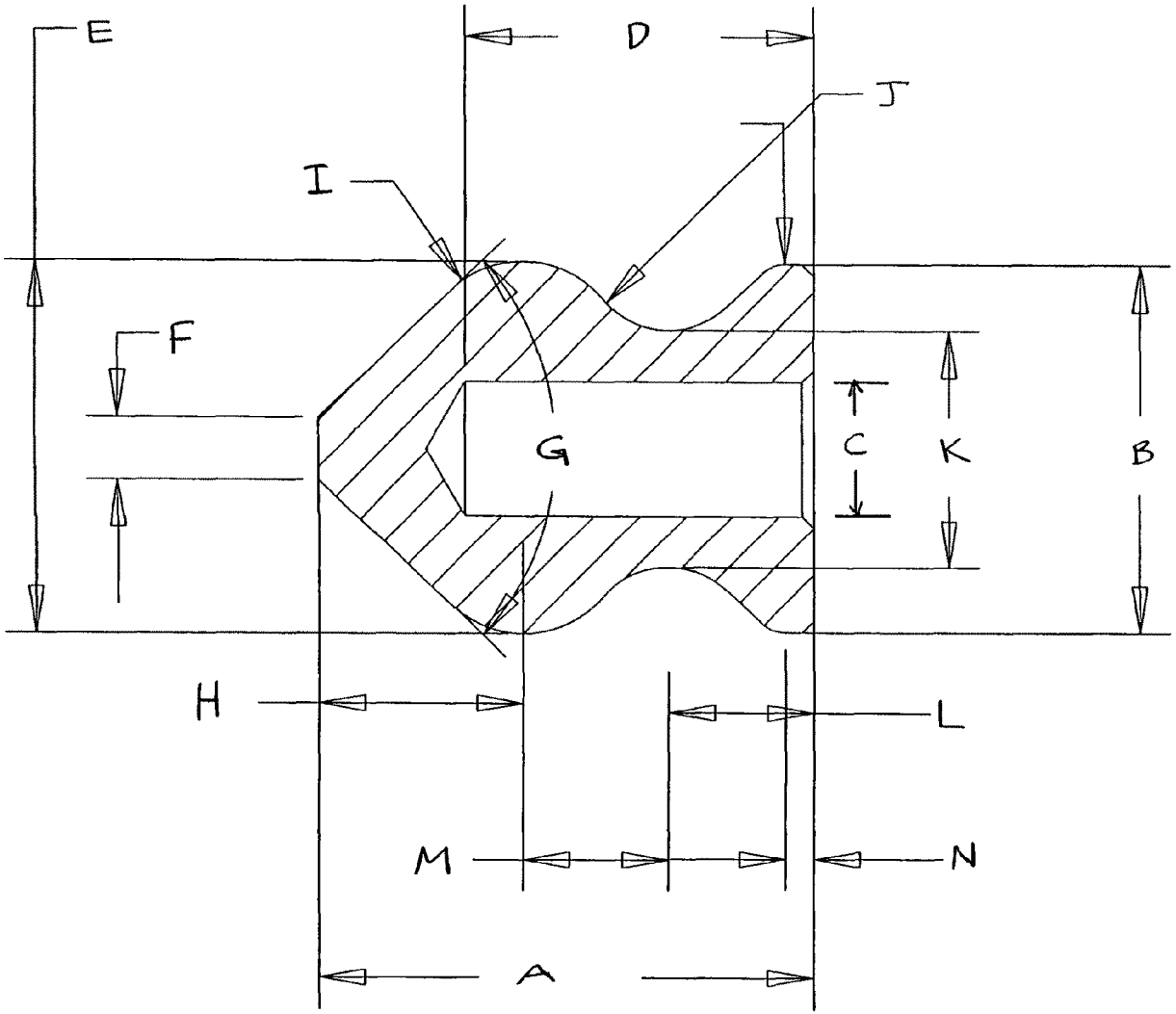
FIG. 3 is a detailed section view of a standard tip, as depicted in FIG. 1.

In the various figures, numeric and alphabetical identifiers associated with structures or dimensions denote functionally identical structures or dimensions, except that a prime (') on an identifier indicates that it differs from the standard specification associated with FIGS. 1 and 3.

Figure 2:
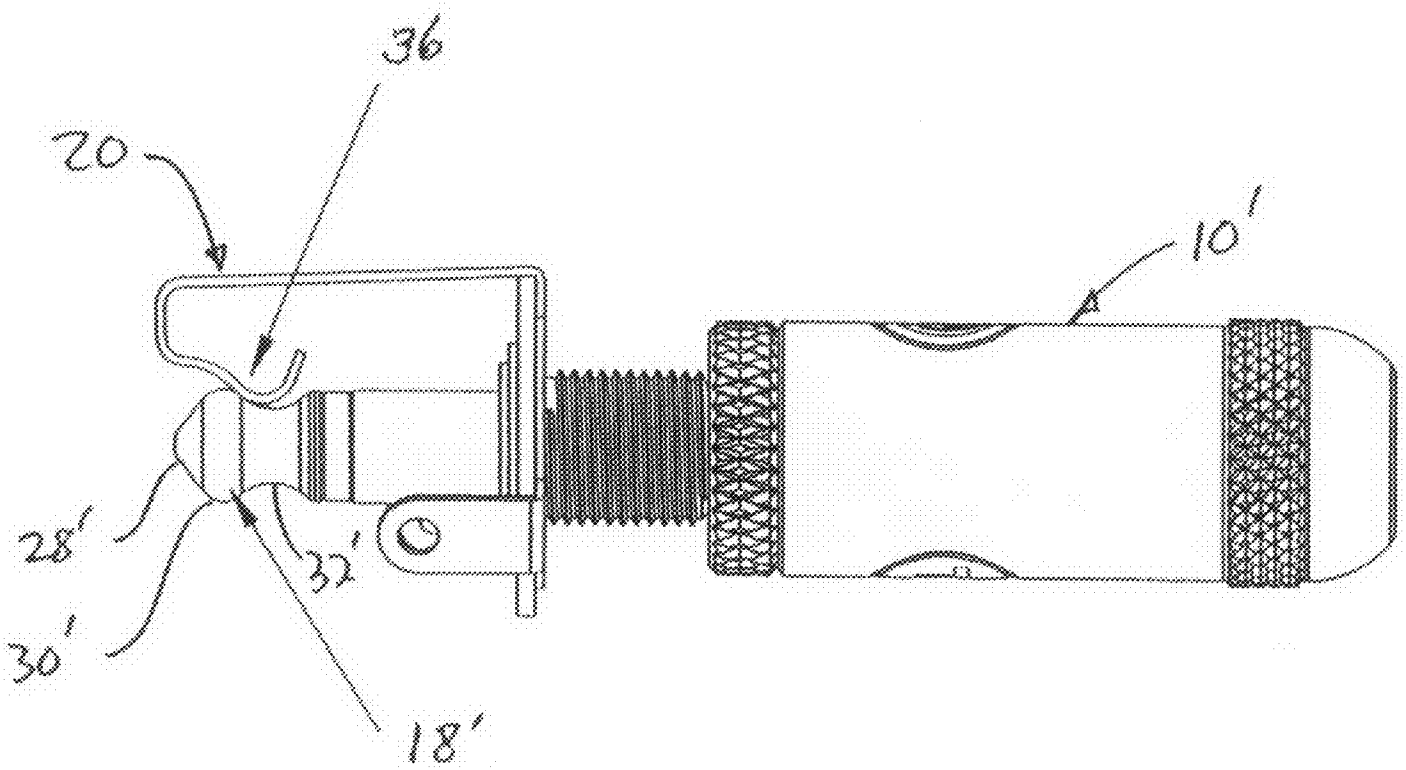
FIG. 2 is similar to FIG. 1, except that the tip of the plug embodies the present invention and achieves a detent condition for the same spring that was out of the specification as depicted in FIG. 1.

FIGS. 1 and 2 show an electric plug 10 having a coaxially aligned handle 12, a plug collar 14 at the front of the handle, a signal shaft 16 projecting from the plug collar and a tip 18 on the shaft, as inserted into a mating jack 20 where the collar 14 on the plug confronts a collar 22 projecting from the front wall 24 of the jack and a spring 26 within the jack engages the tip 18. As is well known, the shaft portion 16 of the plug insertable into the jack has insulation separating the signal-carrying central conductor from a coaxial ground conductor, with each having leads or contacts extending into the handle 12 for electrical connection with respective leads or contacts in a cable (not shown).

The tip 18 has a frustoconical nose 28 with associated minor and major diameter, which transitions into a convex annular shoulder 30, which in turn transitions into a saddle-shape, concave annular waist 32, which finally transitions to an annular base 34. As the plug 10 and jack 20 mate according to standard specifications, the convexly curved portion 36 of the jack spring rides over the nose 28 and shoulder 30 until it snaps into the detent 32 formed by the waist between the shoulder and the base. This detent prevents the fully inserted plug from axial displacement within the jack, unless the musician intentionally applies a significant axial pulling force to disengage the plug tip from the spring.

With the relationship of the standard plug 10 and out of specification jack 20 as shown in FIG. 1, the spring contact 36 remains on the shoulder 30 and, as a consequence, applies only a radial force component to the tip. As a consequence, the tip 18 can easily be disengaged from the spring.

FIG. 2 shows that with a tip 18' according to the present invention, the spring 36 of the same jack 20, will properly snap into the detent 32'.

Figure 4:
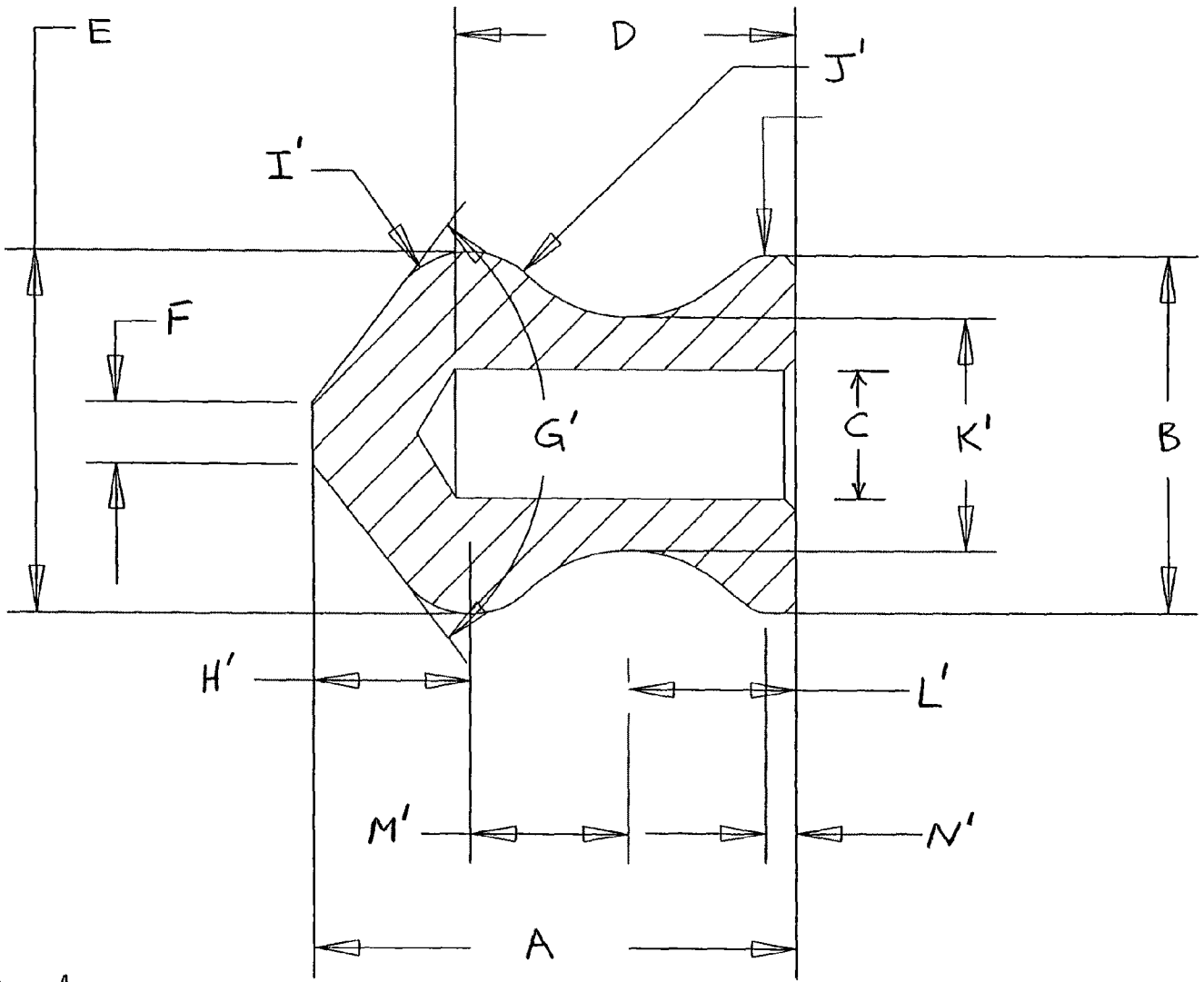
FIG. 4 is a detailed section view of a tip according to the invention, as depicted in FIG. 2.

FIGS. 3 and 4 are detailed section views of the standard and inventive tips 18, 18', respectively. Various dimensions have been specified by a capital letter. Differences in dimensions associated with the preferred embodiment of the invention are indicated by a prime (').

The following Table presents a comparison of the standard dimensions, the range of values within the scope of the invention that are different from the standard dimensions, and the preferred value of the different dimensions. It can be appreciated that dimensions A through F are preferably identical to the standard dimensions, whereas dimensions G-N are different. Also, certain combinations of dimensions are different.

TABLE OF COMPARATIVE DIMENSIONS
(in inches unless indicated otherwise)

| DESCRIPTION | ID | STANDARD DIMENSION | INVENTIVE RANGE | PREFERRED VALUE |
|---|---|---|---|---|
| Overall Length | A | 0.334 | | 0.334 |
| Base diameter | B | 0.244 | | 0.244 |
| Bore diameter | C | 0.089 | | 0.089 |
| Bore length | D | 0.235 | | 0.235 |

-continued

TABLE OF COMPARATIVE DIMENSIONS
(in inches unless indicated otherwise)

| DESCRIPTION | ID | STANDARD DIMENSION | INVENTIVE RANGE | PREFERRED VALUE |
|---|---|---|---|---|
| Shoulder diameter | E | 0.247 | | 0.247 |
| Nose front diameter | F | 0.042 | | 0.042 |
| Nose angle (degrees) | G | 86 | 95-120 | 104 |
| Nose front to shoulder center | H | 0.138 | 0.100-0.120 | 0.109 |
| Shoulder radius | I | 0.07 | | 0.06 |
| Waist radius of curvature | J | 0.058 | 0.075-0.115 | 0.100 |
| Waist diameter | K | 0.157 | >/=0.160 | 0.160 |
| Base to waist center | L | 0.098 | | 0.116 |
| Shoulder center to waist center | M | 0.098 | >0.105 | 0.109 |
| Base length | N | 0.019 | | 0.021 |
| Base to shoulder center | M + L | 0.196 | | 0.225 |
| Nose front to shoulder center | A − H | 0.196 | | 0.225 |
| Nose front to waist center | H + M | 0.236 | | 0.218 |

It should be appreciated that not all of the differences indicated in the Table are necessary to achieve a significant improvement relative to a standard plug.

One combination of noteworthy features is that the nose 28 has an increased angle G' of at least 95° with the axis, the annular shoulder 30' is centered at an axial distance H' of less than 0.120 inch from the front end of the tip, and the waist has a radius of curvature J' greater than about 0.075 inch.

Another combination of noteworthy features is that the annular shoulder 30' is centered at an axial distance H' from the front end of the tip substantially equal to one-half the axial distance from the front end of the tip to the center of the waist (H'+M'), i.e., whereas in the standard tip the dimension H is significantly greater than the dimension M, with applicant's preferred embodiment the dimension H' is substantially equal to M'.

In yet another combination of significant features, for a tip having a standard overall length of about 0.334 inch, the annular shoulder 30' is centered at an axial distance H' of less than about 0.120 inch from the front end of the tip and the waist has a radius of curvature J' greater than about 0.075 inch, without limitation on the nose angle G'. Preferably, the terminus of the threaded blind bore is at substantially the same axial position as the center of the shoulder 30'. This is evident in the Table, from the combined dimensions (M'+L'), or alternatively (A−H') which each 0.225, i.e., within 0.010 inch of the dimension D of the bore length. In the corresponding standard tip, this dimension is 0.196 inch, i.e., about 0.040 less than the bore length D of 0.235 inch.

The blind bore can be smooth if the tip is to be permanently secured to a smooth extension of the signal conductor of the shaft, or the bore can be threaded to receive a threaded extension of the signal shaft.

It should be appreciated that notwithstanding the superficial similarity between the tips as depicted in FIGS. 3 and 4, the dimensional differences set forth in the Table, especially the difference between the preferred dimensions and the standard dimensions, produce significant improvements in performance.

The invention claimed is:

1. An electric plug having a coaxially aligned handle, a plug collar at one end of the handle, a shaft projecting from the plug collar and a tip on the shaft, for insertion into a mating jack where the plug collar confronts a front wall of the jack and a spring within the jack engages the tip, said tip having a substantially frustoconical nose defining the front end of the tip and which axially transitions to a convex annular shoulder which axially transitions to a concave annular waist, which axially transitions to an annular base, wherein the improvement comprises that:

the annular shoulder is centered at an axial distance of less than 0.120 inch from the front end of the tip;

the waist has a radius of curvature greater than about 0.075 inch.

2. The electric plug of claim 1, wherein the tip has an axially extending, threaded blind bore from an entry at the base to a terminus at an axial position which is substantially at the axial distance of the center of the shoulder from the front end of the tip; and said shaft is secured in said bore.

3. The electric plug of claim 1, wherein the nose forms an angle of at least 95 degrees, preferably between about 100 and 110 degrees.

4. The electric plug of claim 1, wherein the center of the annular shoulder and the center of the waist are axially spaced apart by at least about 0.105 inch, preferably about 0.110 inch.

5. The electric plug of claim 1, wherein the waist has a radius of curvature of about 0.100.

6. The electric plug of claim 1, wherein the waist has a minimum diameter of at least 0.160 inch.

7. The electric plug of claim 1, wherein, the plug has an overall length of 0.334 inch;

the nose angle is 104 deg.

the annular shoulder is centered at an axial distance of 0.109 inch from the front end of the tip; and the waist has a radius of curvature of 0.100 inch and a diameter of 0.160 inch.

8. An electric plug having a coaxially aligned handle, a plug collar on the handle, a shaft projecting from the plug collar and a tip on the shaft, for insertion into a mating jack where the plug collar confronts a front wall of the jack and a spring within the jack engages the tip, said tip having a substantially frustoconical nose defining the front end of the tip and which axially transitions to a convex annular shoulder which axially transitions to a concave annular waist, which axially transitions to an annular base defining the back end of the tip, wherein the improvement comprises that:

the waist is centered at an axial distance from the front end of the tip; and the annular shoulder is centered at an axial distance from the front end of the tip substantially equal to one half said axial distance of the center of the waist.

9. The electric plug of claim 8, wherein the center of the annular shoulder and the center of the waist are axially spaced apart by at least about 0.105 inch.

10. The electric plug of claim 8, wherein the waist has a radius of curvature of about 0.100 inch.

11. The electric plug of claim 8, wherein the waist has a minimum diameter of at least 0.160 inch.

12. The electric plug of claim 8, wherein, the plug has an overall length of 0.334 inch;

the annular shoulder is centered at an axial distance of 0.109 inch from the front end of the tip; and the waist has a radius of curvature of 0.100 inch and a diameter of 0.160 inch.

13. The electric plug of claim 12, wherein the nose makes an angle of about 105 deg. with the axis.

14. A tip for a ¼ inch phone plug comprising:

a substantially frustoconical nose having a small diameter front defining the front end of the tip and a large diameter back end;

a convex annular shoulder which axially transitions from the back end of the nose;

a concave annular waist which transitions from the shoulder;

an annular base which transitions from the waist and defines the back end of the tip;

a bore of substantially uniform diameter defining a tip longitudinal axis, extending from an entry at the back end of the tip to a terminus forward of the waist;

wherein the tip has a length from the front end to the back end of about 0.334 inch, the annular shoulder is centered at an axial distance of less than about 0.120 inch from the front end of the tip, and the waist has a radius of curvature J' greater than about 0.075 inch.

15. The tip of claim 14, wherein the nose forms a conical angle of about 104 deg. to the axis;

the annular shoulder is centered at an axial distance of about 0.109 inch from the front end of the tip; and the waist has a radius of curvature J' of about 0.100 inch and a minimum diameter of 0.160 inch.

16. The tip of claim 14, wherein the waist is centered at an axial distance from the front end of the tip; and the annular shoulder is centered at an axial distance from the front end of the tip substantially equal to one half said axial distance of the center of the waist.

17. The tip of claim 14, wherein the axial distance from the front end of the tip to the center of the waist is about 0.218 inch.

18. The tip of claim 14, wherein the terminus of the threaded bore is at substantially the same axial position as the center of the shoulder.

* * * * *